US009127867B2

(12) United States Patent
Tanno et al.

(10) Patent No.: US 9,127,867 B2
(45) Date of Patent: Sep. 8, 2015

(54) HEAT SOURCE UNIT

(75) Inventors: Hideki Tanno, Fuji (JP); Masahiro Okada, Fuji (JP); Kenjiro Matsumoto, Fuji (JP); Takamitsu Ishiguro, Fuji (JP)

(73) Assignee: Toshiba Carrier Corporation, Minato-ku, Tokyo ( * ) Notice: Subject to any disclaimer, the term of this patent is extended or adjusted under 35 U.S.C. 154(b) by 0 days.

(21) Appl. No.: 13/358,546

(22) Filed: Jan. 26, 2012

(65) Prior Publication Data

US 2012/0125033 A1 May 24, 2012

Related U.S. Application Data

(63) Continuation of application No. PCT/JP2010/062637, filed on Jul. 27, 2010.

(30) Foreign Application Priority Data

Jul. 28, 2009 (JP) ..... 2009-175624
Jul. 28, 2009 (JP) ..... 2009-175625

(51) Int. Cl.
*F25B 30/02* (2006.01)
*F24F 3/06* (2006.01)
(Continued)

(52) U.S. Cl.
CPC . *F25B 30/02* (2013.01); *F24F 3/06* (2013.01); *F28B 1/06* (2013.01); *F28D 1/0477* (2013.01); *F28D 2001/0273* (2013.01); *F28F 1/32* (2013.01); *F28F 9/262* (2013.01)

(58) Field of Classification Search
CPC ..... F25B 39/04; F25B 2313/0253; F25B 2339/04; F25B 2339/043; F25B 5/00; F25B 5/02; F25B 5/04; F28F 1/06; F28F 1/14; F28F 1/16; F28F 1/18; F28F 1/68; F28F 1/10
USPC ..... 62/506, 117, 324.1, 428, 175; 165/121, 165/201
See application file for complete search history.

(56) References Cited

U.S. PATENT DOCUMENTS 1,954,543 A 4/1934 Schwarz
3,731,497 A * 5/1973 Ewing ..... 62/160
(Continued)

FOREIGN PATENT DOCUMENTS

JP 42-013506 8/1967
JP 54-52751 4/1979
(Continued)

OTHER PUBLICATIONS

English Language Abstract of JP 2004-340504 published on Dec. 2, 2004.
(Continued)

*Primary Examiner* — Frantz Jules
*Assistant Examiner* — Erik Mendoza-Wilkenfel
(74) *Attorney, Agent, or Firm* — DLA Piper LLP (US)

(57) ABSTRACT

According to one embodiment, a heat source unit apparatus includes air heat exchangers, each includes a plurality of fins arranged at prescribed intervals, heat exchanging pipes penetrating the fins, and bent strips extending at sides and bent in the same direction, and a heat exchange module includes two air heat exchangers, each having the bent strips opposed to those of the other air heat exchanger, the air heat exchangers being inclined such that lower edges are close to each other and upper edges are spaced apart, whereby the heat exchange module is shaped like a letter V as seen from side.

1 Claim, 8 Drawing Sheets

(51) Int. Cl.

| | |
|---|---|
| ***F28B 1/06*** | (2006.01) |
| ***F28D 1/047*** | (2006.01) |
| *F28D 1/02* | (2006.01) |
| *F28F 1/32* | (2006.01) |
| *F28F 9/26* | (2006.01) |

(56) References Cited

U.S. PATENT DOCUMENTS

| | | | | | |
|---|---|---|---|---|---|
| 4,151,722 | A | | 5/1979 | Willitts et al. | |
| 4,336,692 | A | * | 6/1982 | Ecker et al. | 62/82 |
| 4,559,788 | A | | 12/1985 | McFarlan | |
| 5,181,395 | A | * | 1/1993 | Carpenter et al. | 62/506 |
| 5,269,153 | A | * | 12/1993 | Cawley | 62/180 |
| 5,327,742 | A | * | 7/1994 | Duff et al. | 62/175 |
| 5,619,863 | A | * | 4/1997 | Kil | 62/428 |
| 5,685,166 | A | * | 11/1997 | Li | 62/428 |
| 5,743,110 | A | * | 4/1998 | Laude-Bousquet | 62/434 |
| 6,519,966 | B1 | * | 2/2003 | Martin, Sr. | 62/324.1 |
| 6,769,481 | B2 | * | 8/2004 | Yoshimura et al. | 165/240 |
| 2004/0129015 | A1 | | 7/2004 | Apparao et al. | |
| 2005/0039479 | A1 | * | 2/2005 | Kim | 62/262 |
| 2005/0103032 | A1 | * | 5/2005 | Pierson | 62/175 |
| 2007/0261421 | A1 | | 11/2007 | Pierson | |
| 2008/0148746 | A1 | * | 6/2008 | Yanik et al. | 62/115 |
| 2009/0025404 | A1 | | 1/2009 | Allen | |
| 2010/0115984 | A1 | * | 5/2010 | MacBain et al. | 62/434 |
| 2010/0162739 | A1 | * | 7/2010 | Kopko et al. | 62/115 |
| 2012/0125033 | A1 | | 5/2012 | Tanno et al. | |

FOREIGN PATENT DOCUMENTS

| | | | |
|---|---|---|---|
| JP | 54-110844 | | 8/1979 |
| JP | 54-142642 | | 11/1979 |
| JP | 56-29762 | | 2/1981 |
| JP | 60-86872 | | 6/1985 |
| JP | 61-66756 | U | 5/1986 |
| JP | 62-00931 | | 1/1987 |
| JP | 63-91440 | | 4/1988 |
| JP | 4-350468 | | 12/1992 |
| JP | 05-069537 | U | 9/1993 |
| JP | 09-014698 | | 1/1997 |
| JP | 2000-346402 | | 12/2000 |
| JP | 2001-21284 | | 1/2001 |
| JP | 2002-243208 | | 8/2002 |
| JP | 2002-243209 | | 8/2002 |
| JP | 2003-056930 | | 2/2003 |
| JP | 2003-279074 | | 10/2003 |
| JP | 2004-239539 | | 8/2004 |
| JP | 2004-0340504 | | 12/2004 |
| JP | 2004-340533 | | 12/2004 |
| JP | 2004-360975 | | 12/2004 |
| JP | 2005-98607 | | 4/2005 |
| JP | 2005-195324 | | 7/2005 |
| JP | 3700481 | | 7/2005 |
| JP | 2005-315480 | | 11/2005 |
| JP | 2007-139262 | | 6/2007 |
| JP | 2007-163017 | | 6/2007 |
| JP | 2007163017 | * | 6/2007 |
| JP | 2007-187353 | | 7/2007 |
| JP | 2008-138951 | | 6/2008 |
| JP | 2008-175476 | | 7/2008 |
| JP | 2008-267722 | | 11/2008 |
| JP | 2008-267729 | | 11/2008 |
| JP | 2009-079851 | | 4/2009 |
| JP | 2009-138037 | | 6/2009 |

OTHER PUBLICATIONS

English Language Translation of JP 2004-340504 published on Dec. 2, 2004.
English Language Abstract of JP 2007-163017 published on Jun. 28, 2007.
English Language Translation of JP 2007-163017 published on Jun. 28, 2007.
English Language Abstract of JP 2001-21284 published on Jan. 26, 2001.
English Language Translation of JP 2001-21284 published on Jan. 26, 2001.
English Language Abstract of JP 2008-138951 published on Jun. 19, 2008.
English Language Translation of JP 2008-138951 published on Jun. 19, 2008.
English Language Abstract of JP 60-86872 published on Jun. 14, 1985.
English Language Abstract of JP 2005-195324 published on Jul. 21, 2005.
English Language Translation of JP 2005-195324 published on Jul. 21, 2005.
International Search Report issued in PCT/JP2010/062637.
International Preliminary Report on Patentability and Written Opinion issued in PCT/JP2010/062637 on Feb. 9. 2012.
Japanese Office Action issued in JP 2011/524796 on May 7, 2013.
English Language Translation of Japanese Office Action issued in JP 2011/524796 on May 7, 2013.
Korean Office Action issued in 10-2012-7001910 issued Jun. 21, 2013.
English Language Translation of Korean Office Action issued in 10-2012-7001910 issued Jun. 21, 2013.
English Language Abstract of JP 2009-079851 published Apr. 16, 2009.
English Language Translation of JP 2009-079851 published Apr. 16, 2009.
Japanese Office Action issued in JP 2011-524796 on Jan. 7, 2014.
English Language Translation of Japanese Office Action issued in JP 2011-524796 on Jan. 7, 2014.
English Language Abstract and Translation of JP 09-014698 Published on Jan. 17, 1997.
English Language Abstract and Translation of JP 2005-315480 published Nov. 10, 2005.
English Language Abstract and Translation of JP 2008-267729 published Nov. 6, 2008.
English Language Abstract and Translation of JP 2002-243208 published Aug. 28, 2002.
English Language Abstract and Translation of JP 2007-139262 published Jun. 7, 2007.
English Language Abstract of JP 63-091440 published Apr. 22, 1988.
English Language Abstract of JP 62-00931 published Jan. 17, 1987.
Korean Office Action issued in KR 10-2013-7022073 on Sep. 26, 2013.
English Language Translation of Korean Office Action issued in KR 10-2013-7022073 on Sep. 26, 2013.
English Language Abstract and translation of JP 2008-267722 published on Nov. 6, 2008.
English Language Abstract and translation of JP 20003-056930 published Feb. 26, 2003.
English Language Abstract and translation of JP 2003-279074 published on Oct. 2, 2003.
Chinese Search Report issued in CN 2010800324941 Nov. 8, 2013.
English Language Translation of Chinese Search Report issued in CN 2010800324941 Nov. 8, 2013.
English Language Translation of JP 05-069537 U published on Sep. 21, 1993.
English Language Translation of JP 3700481 U published on Jul. 22, 2005.
Japanese Office Action issued in JP 2013-143062 on Apr. 15, 2014.
English Language Translation of Japanese Office Action issued in JP 2013-143062 on Apr. 15, 2014.
English Language Abstract of JP 54-142642 published on Nov. 7, 1979.
English Language Abstract and Translation of JP 2000-346402 published Dec. 15, 2000.
English Language Abstract and Translation of JP 2007-187353 published on Jul. 26, 2007.
English Language Abstract and Translation of JP 2002-243209 published on Aug. 28, 2002.

(56) References Cited

OTHER PUBLICATIONS

English Language Abstract and Translation of JP 2008-175476 published on Jul. 31, 2008.
Japanese Office Action issued in JP 2013-143062 on Dec. 2, 2014 with English Language Translation.
English Language Abstract of JP 4-350468 published on Dec. 4, 1992.
English Language Abstract and Translation of JP 2004-239539 published on Aug. 26, 2004.
English Language Abstract and Translation of JP 2005-98607 published on Apr. 14, 2005.
English Language Abstract and Translation of JP 2004-340533 published on Dec. 2, 2004.
English Language Abstract and Translation of JP 2009-138037 published on Jun. 25, 2009.
English Language Abstract and Translation of JP 2004-360975 published on Dec. 24, 2004.
U.S. Appl. No. 13/975,125.

* cited by examiner

HEAT SOURCE UNIT

CROSS REFERENCE TO RELATED APPLICATIONS

This application is a Continuation Application of PCT Application No. PCT/JP2010/062637, filed. Jul. 27, 2010 and based upon and claiming the benefit of priority from prior Japanese Patent Applications No. 2009-175624, filed Jul. 28, 2009; and No. 2009-175625, filed Jul. 28, 2009, the entire contents of all of which are incorporated herein by reference.

FIELD

Embodiments described herein relate generally to a heat source unit constituting a multi-type air conditioner, heat pump hot water supplying, apparatus or a refrigerating apparatus.

BACKGROUND

The multi-type air conditioner, the heat pump hot-water supplying apparatus or the refrigerating apparatus incorporates a heat exchange unit. The heat exchange unit is generally called a "heat source unit," and will hereinafter be referred to as a "heat source unit."

The heat source unit comprises a heat exchanging chamber, a machine compartment, air, heat exchangers arranged in the heat exchanging chamber, blowers configured to supply air to the air heat exchangers, and refrigeration cycle components provided in the machine compartment. Two air heat exchangers are provided in one unit. The air heat exchangers are arranged to face each other and form a unit shaped like a V. This is one of the characterizing features of the heat source unit.

The machine compartment is shaped like an inverted V. This is one of the characterizing features of the machine compartment. The refrigeration cycle parts that the machine compartment incorporates are a compressor, a four-way valve, the above-mentioned heat exchangers, an expansion valve, and a water heat exchanger. A plurality of heat source units of this type are arranged side by side, constituting one apparatus.

In any heat source unit of this type, a plurality of compressors are arranged parallel in most cases, constituting one refrigeration cycle.

At the bottom of the compressor, an oil reservoir is provided to collect lubricating oil. As the shaft rotates, the oil is drawn up by suction from the oil reservoir and applied to the sliding part of the compressor mechanical, section. Most of the lubricating oil so applied flows back to the oil reservoir. Only a part of the oil is mixed with the refrigerant gas and ejected into the refrigeration cycle, and returns to the oil reservoir after circulating in the refrigeration cycle.

If a plurality of compressors are connected in parallel in one refrigeration cycle as has hitherto been practiced, a subtle, pressure difference will be observed between the compressors. This difference causes the lubricating oil to flow into the compressor at the lowest pressure. If this state is prominent, the lubricating oil will accumulate in one compressor, and will scarcely exists in any other compressor. Consequently, the compressor mechanism section may suffer from a burnout in some cases.

Therefore, the compressors arranged in parallel are connected by oil balancing pipes, constituting an additional circuit, and a resisting member is provided in the refrigerant intake pipe of each compressor, inducing a forced pressure loss. This measure holds the lubricating oil at the same level in the compressors, preventing the oil from accumulating in one compressor only.

If a forced pressure loss is induced in any compressor, however, the compressor will have its compressing, ability decreased. The compressor should therefore be replaced by a compressor having a compressing ability one rank higher. Further, a system must be used to confirm whether the oil is reliably applied in the compressor. This inevitably influence the cost.

In winter, water may be frozen, forming frost on the air heat exchangers, while the air heat exchangers are operating in the heating mode. In this case, the air heat exchangers must be driven in defrosting mode. More specifically, the heating cycle is switched to the cooling cycle, in which the refrigerant is condensed in the air heat exchangers, melting the frost with the resulting heat of condensation. At this point, however, if any compressor has a trouble, the other compressors cannot be drive to achieve defrosting.

DETAILED DESCRIPTION

A heat source unit according to an embodiment is provided with air heat exchangers, each including plurality of fins arranged at prescribed intervals, heat exchanging pipes penetrating the fins, and bent strips extending at sides and bent in the same direction, and, a heat exchange module including two air heat exchangers, each having the bent strips opposed to those of the other air heat exchanger, the air heat exchangers being inclined such that lower edges are close to each other and upper edges are spaced apart, whereby the heat exchange module is shaped like a letter V as seen from side.

A heat source unit according to an embodiment is provided with heat exchange modules, each including two air heat exchangers, each having bent strips extending at sides, bent in the same direction and opposed to those of the other heat exchanger, the air heat exchangers being inclined such that lower edges are close to each other and upper edges are spaced apart, whereby the heat exchange module is shaped like a letter V as seen from side, a blower provided between the upper parts of the air heat exchangers constituting the heat exchange module, and configured to draw air from outside the air heat exchangers, to apply the air into the air heat exchangers and to discharge the air through a gap between the upper parts of the air heat exchangers, a drain pan on and to which the lower parts of the air heat exchangers are held and secured, and a machine compartment provided below the drain pan and incorporating all refrigeration cycle components, except at least the air heat exchangers, wherein a plurality of heat exchange module are arranged in a direction orthogonal to the direction in which the air heat exchangers oppose to each other.

A heat source unit according to an embodiment is provided with a plurality of refrigeration cycles of heat-pump type, which communicate with one another via refrigerant pipes and are independent of one another, and each of which comprises a plurality of compressors, a plurality of four-way valves, a plurality of air heat exchangers, a plurality of expansion valves and a plurality of water heat exchangers; each of the water heat exchangers comprises refrigerant passages for guiding refrigerant circulating in the refrigeration cycle and water passages for circulating water to exchange heat with the refrigerant guided into the refrigerant passages; the water passages of the water heat exchangers are connected in series by water pipes; and the refrigerant passages of each water heat exchanger communicate, respectively with the refrigeration cycles independent of one another.

Figure 1:
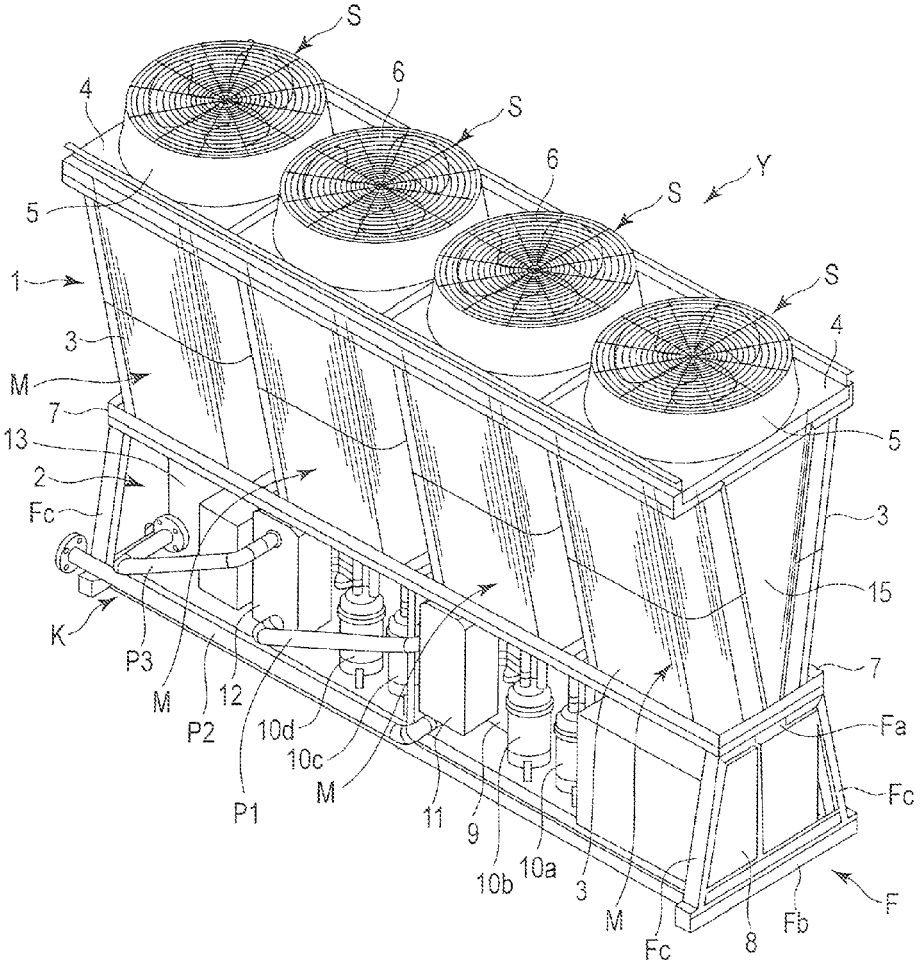
FIG. 1 is a perspective view showing a heat source unit according to an embodiment.
Figure 2:
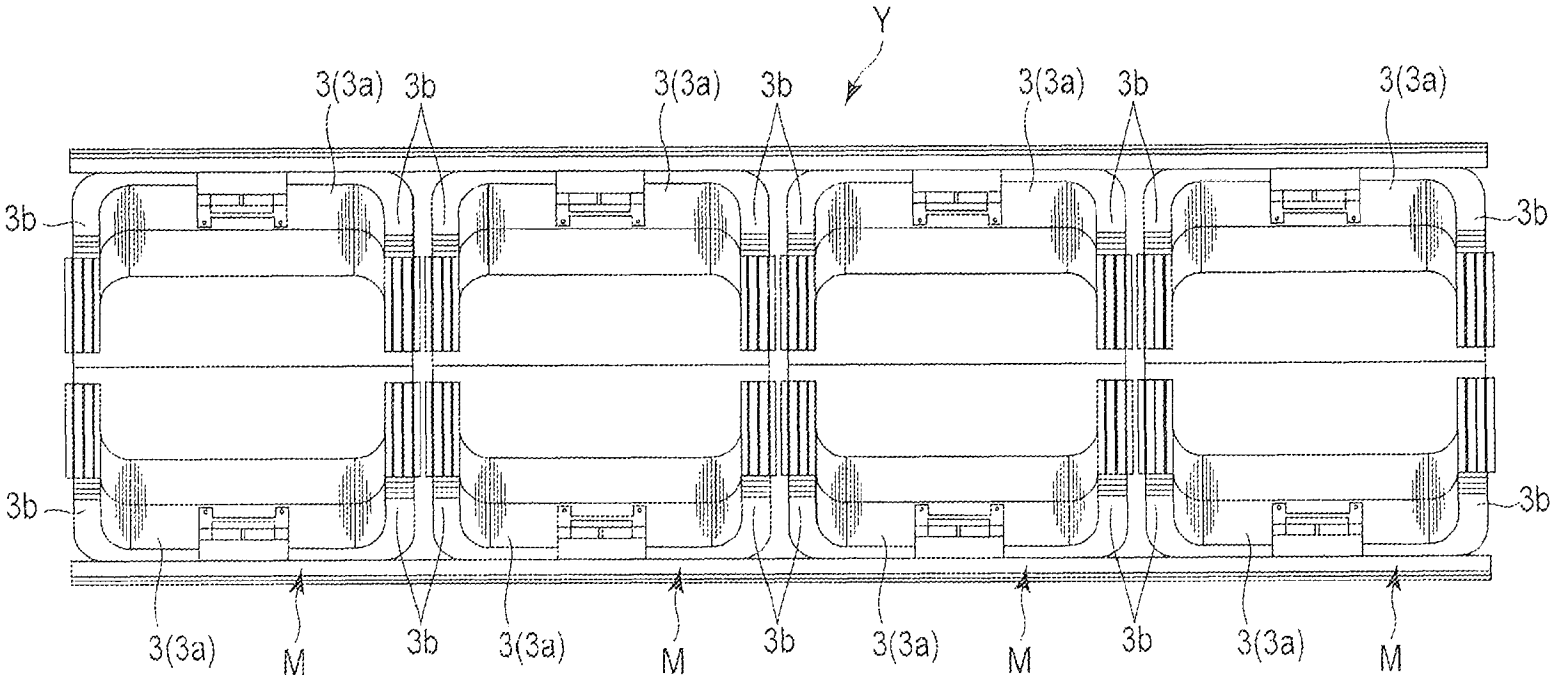
FIG. 2 is a plan view of the heat source unit, not showing a part of the heat source unit.

FIG. 1 is a perspective view showing a heat source unit Y, assembled and completed, not showing a part of the heat source unit Y. FIG. 2 is a plan view of the heat source unit, with a part removed.

The heat source unit Y is supplied with cold water or hot water, and is designed to cool air with the cold water or to heat air with the hot water. The heat source unit Y can therefore be used as a heat pump hot-water supplying apparatus, a multi-type air conditioner or a refrigerating apparatus.

The heat source unit Y comprises a heat exchanging section 1, i.e., upper half section, and a machine compartment 2, i.e., lower half section.

The heat exchanging section 1 comprises a plurality of heat exchange modules M (four modules in this case) and the same number of blowers S. Each heat exchange module M comprises a pair of air heat exchangers 3 that are arranged, facing each other. The heat exchange modules M are arranged in a lengthwise direction, spaced from one another.

A top plate 4 is provided at the upper ends of the heat exchange modules M. The blowers S are secured to the top plate 4 aligned with the heat exchanger modules M, respectively. Note that the top plate 4 has hollow-cylindrical blower ducts 5, each projecting upwards from the top plate 4. The blower ducts 5 are covered, at top, with finger guards 6.

Each blower S arranged in one blower duct 5 comprises a propeller fan and a fan motor. The shaft of the propeller fan opposes the finger guard 6 and is secured thereto. The fan motor has its shaft coupled to the propeller fan.

Each heat exchanger module M having a pair of air heat exchangers 3 looks like an elongated rectangle as viewed from front. The described above, they are arranged side by side, each spaced from another as described above. The air heat exchangers 3 are spaced apart by a short distance at the top plate 4, i.e., the upper end, and by a long distance at the machine compartment 2, i.e., the lower end. The air heat exchangers 3 so incline that they look like a letter V as seen from side.

At the lower end of the heat exchanging section 1, a frame unit F is provided. The frame unit F comprises an upper frame Fa, a lower frame Fb, and a vertical frame Fc. The vertical frame Fc couples the upper frame Fa and the lower frame Fb together. Side walls and end plates are secured to the frame unit F, defining a space. This space is the above-mentioned machine compartment 2.

The upper frame Fa and the lower frame Fb are assembled, each shaped like a transversely long rectangle as viewed from above. They have the same length as measured in horizontal direction. However, the upper frame Fa has a shorter than the lower frame Fb in the depth direction that is orthogonal to the horizontal direction.

That is, the upper frame Fa has a small depth that is equal to the depth the heat exchange module M. Therefore, the vertical frame Fc coupling the upper frame Fa and the lower frame Fb gradually flares from the top to the bottom, with its constituent members inclined. As a result, the frame F looks like an inverted V as seen from side.

Thus, the heat exchanging section 1 appears like a letter V as seen from side, gradually narrowing in the depth direction, from the upper end toward the lower end. The machine compartment 2 provided at the lower end of the heat exchanging section 1 gradually flares in the depth direction, from the machine compartment 2 or from the upper end toward the lower end, and therefore appears like an inverted V as viewed from side. The heat source unit Y is therefore shaped like an hourglass as seen from side.

An upper drain pan 7 is secured to the upper frame Fa, filling the space defined by the upper frame Fa. The upper drain pan 7 has its lower side mounted on a reinforcing member. The upper drain pan 7 is thereby reinforced. On the upper drain pan 7, the pair of air heat exchangers 3, which constitute one head exchanger module M, are mounted at their lower ends.

The upper drain pan 7 has the same depth as the heat exchange modules M, and has such a widthwise length that the plurality of exchanger modules M are spaced from one another, by a prescribed distance.

To the lower frame Fb, the blowers S, an electrical parts box 8 and a lower drain pan 9 are attached. The electrical parts box 8 contains an electrical control unit configured to control electrical refrigeration cycle components. The other refrigeration cycle components, except at least the air heat exchangers 3, are provided, in the machine compartment 2.

The electrical parts box 8 is secured to one of the ends of the machine compartment 2, as viewed in the lengthwise direction of the machine compartment 2. Therefore, the end of the heat source unit Y should better be arranged, with its one end facing to the passage at which the heat source unit Y is installed. That is, any maintenance personnel staying in the passage can have an access to the interior of the electrical parts box 8 merely by removing the end plate b, without entering from the passage. This helps to increase the efficiency of the maintenance work.

The lower drain pan 9 extends over the entire transverse direction, at a part almost central in the depth direction of the lower frame Fb, except that part which holds the electrical parts box 8. Drain hoses are connected, at the upper end, to the partitioned parts of the drain pan 7. The drain hoses open, at the lower end, to the lower drain pan 9. Drain hoses are connected to the lower drain pan 9, too, and extend to a drainage section.

In the heating mode that will be described later, the air heat exchangers 3 exchange heat with air and condense the water contained in the air, forming drain water. At first, the drain water take the form of water drops sticking to the surface of each air heat exchanger 3. The water drops gradually grow and finally roll down. The drain water collected in the upper drain pan 7 flows down through the drain hoses and is collected in the lower drain pan 9. The drain water is then discharged outside the heat source unit Y.

Adjacent to the electrical parts box 8, a first receiver 10*a* and a second receiver 10*b* are arranged side by side. In the vicinity of the second receiver 10*b*, a second water heat exchanger 11, a third receiver 10*c*, and a fourth receiver 10*d* are arranged side by side. In the vicinity of the fourth receiver 10*d*, a first water heat exchanger 12 is arranged. At the end of the machine compartment 2, a water pump 13 is arranged.

A first water supply pipe P1 connects the upper part of the second water heat exchanger 11 to the lower part of the first water heat exchanger 12. A second water supply pipe P2 is connected to the lower part of the second water heat exchanger 11, and extends to that end of the heat source unit Y, which faces away from the electrical parts box 8. A third water supply pipe P3 connects the upper part of the first water heat exchanger 12 to the water pump 13.

The second water supply pipe P2 connected to the lower part of the second water heat exchanger 11 is used as a water outlet pipe, extending to the room to be air-conditioned. A water-inlet pipe is connected to that side of the water pump 13, which faces away from the third water supply pipe P3. The water-inlet pipe is used as return pipe for conveying the water coming from the room to be air-conditioned.

At the other side of the machine compartment 2, refrigeration cycle components K, such as compressors, four-way valves, and an accumulator, are arranged behind the first to fourth receivers 10*a* to 10*d*, the first water heat exchanger 12 and the second water heat exchanger 11. The refrigeration cycle components K are connected by refrigerant pipes, constituting, together with the air heat exchangers 3, a refrigeration cycle which will be described later.

The heat source unit Y has four exchanger modules M, each comprising a pair of air heat exchangers 3. The exchanger modules M constitute the heat exchanging section 1. The machine compartment 2 incorporates a plurality (four sets) of refrigeration cycle components K, excluding at least the air heat exchangers 3. Further, the refrigeration cycle components K constitute a plurality (four sets) of independent refrigeration cycles as will be described later.

Figure 3:
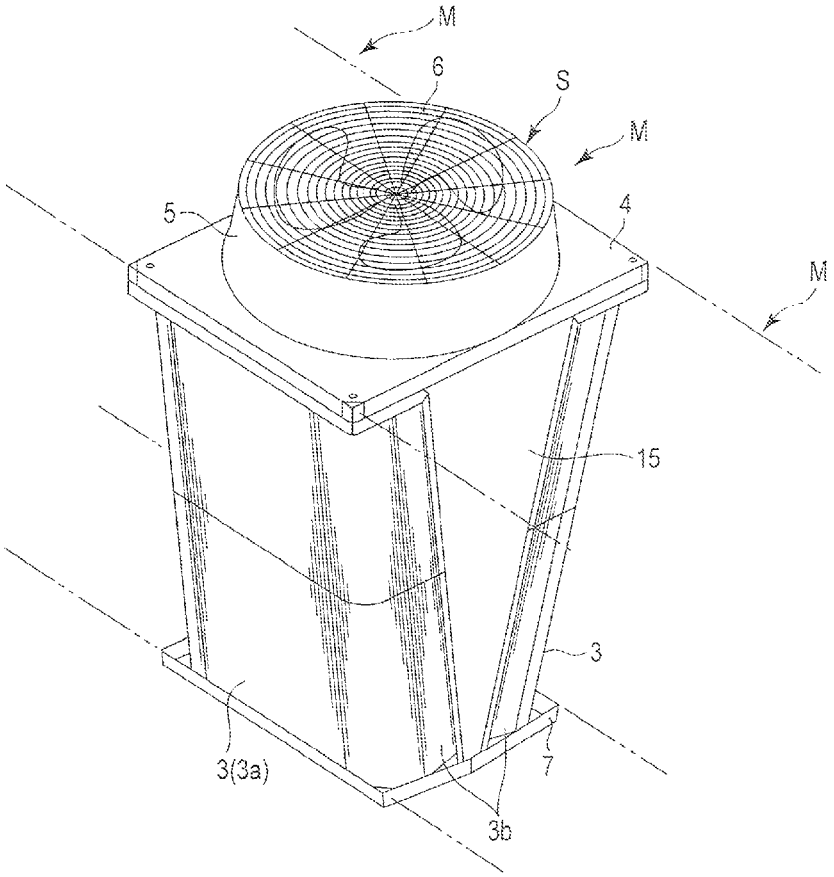
FIG. 3 is a perspective view showing one of the heat exchange modules that constitute the heat source unit.

FIG. 3 is a perspective view showing one of the heat exchange modules M.

Four heat exchange modules M of the type shown in FIG. 3 are arranged, contacting the and top plate 4 and the upper drain pan 7. The heat exchanging section 1 shown in FIGS. 1 and 2 is thereby constituted. The heat exchange modules M are arranged side by side, each spaced from one another by some distance.

Each of the two air heat exchangers 3 constituting one heat exchange module M comprises a flat plate part 3*a* and bent strips 3*b*. The flat plate part 3*a* is shaped like a rectangle as viewed from the front. The bent strips 3*b* are bent at the left and right edges of the flat plate 3*a*, respectively.

A pair of air heat exchangers 3 are arranged with their bent strips 3*a* opposed, and so inclined that they may look like a letter V as seen from side. A V-shaped space is therefore defined between the bent strips 3*b* of one air heat exchanger 3 and those of the other air heat exchanger 3. This space is closed with shield plates 15, each prepared by cutting a plate along a V-shaped line.

The shield plates 15 are provided, respectively at the left and right sides of the heat exchange module M. Therefore, when four heat exchange module M are arranged side by side as shown in FIG. 2, their shield plates 15 will lie close to one another.

Figure 4:
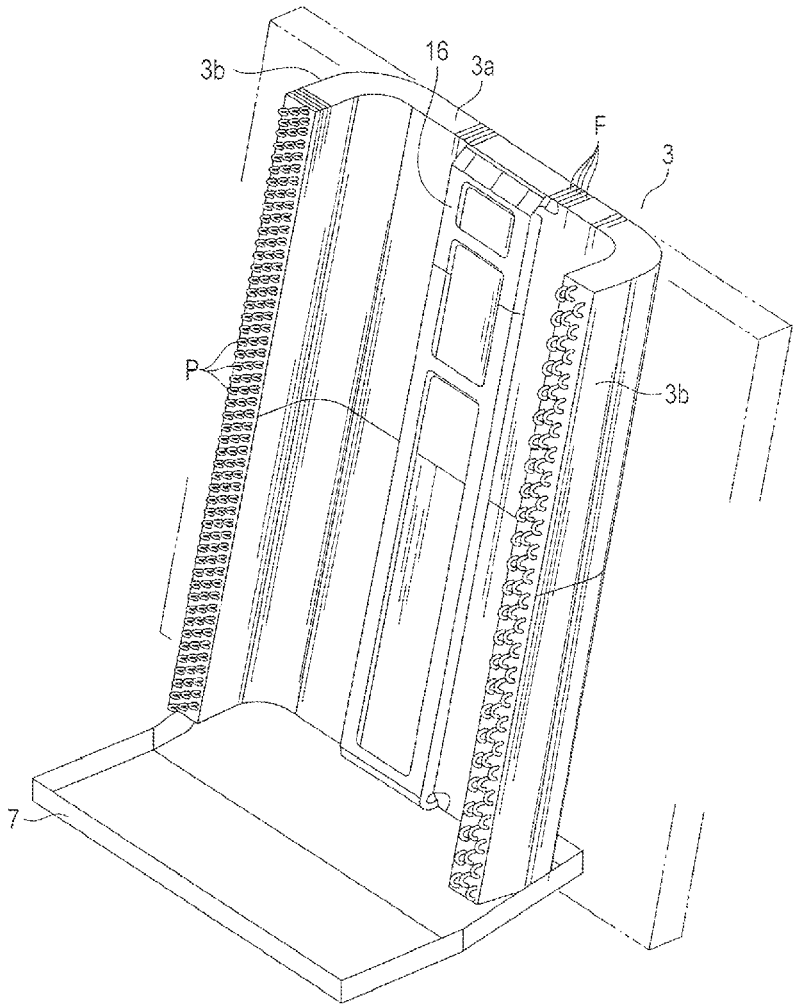
FIG. 4 is a partially sectional view showing the air heat exchanger constituting the heat exchange module.

FIG. 4 is a perspective view of one of two air heat exchanger 3 used in pair and mounted on the upper drain pan 7. The heat exchanger 3 has fins F shaped like extremely elongated strips extending vertically, with narrow gaps between them. Heat exchange pipes P penetrate each fin F, forming three columns spaced in the transverse direction of the fins F. The heat exchange pipes P are arranged, forming a pipe meandering in the longitudinal direction of the fins F.

More precisely, each heat exchange pipe P is bent, forming a U-shaped pipe. Each fin F has many holes, through which the heat exchange pipes P extend. The open ends of each U-shaped pipe are inserted into a prescribed number of fins F, at one side, until they project from the other side. The U-shaped end of each pipe P projects from said one side.

A U bend couples one open end of one U-shaped pipe to one open end of the adjacent U-shaped pipe, forming a turn of a meandering refrigerant passage. The resultant turns communicate with a collecting pipe, finally providing one refrigerant passage. As indicated by the two-dot, chain lines in FIG. 4, the heat exchanger 3 has the same heat-exchanging area as the conventional air heat exchanger that has four columns of heat exchanging pipes. To achieve the same efficiency as the conventional air heat exchanger having four columns of heat exchanging pipes, the heat exchanger 3 having three columns of heat exchanging pipes must be so long as it is short in the pipe column direction.

Nonetheless, the both lateral parts of the heat exchanger 3, which are shaped like a flat plate, are bent in the same direction, forming two bent strips 3*b*. The part existing between the bent strips 3*b* remains as a flat part 3*a*. The heat exchanger 3 looks like a letter U as viewed from above. The heat exchanger 3 has the same heat-exchanging area as the conventional air heat exchanger that has four columns of heat exchanging pipes, and can make the heat source unit Y shorter in the lengthwise direction. This can reduce the installation space of the heat source unit Y and increase the heat-exchanging efficiency thereof.

The heat exchangers 3 constituting the heat exchange module M are positioned so they are inclined to the upper drain pan 7. A holding frame 16 extends from the upper edge of the flat part 3*a* of the heat exchangers 3 to the lower edge thereof. The upper edge of the holding plate 16 is bent like a hook (or shaped like a letter C), contacting the top inner surface, upper edge and top outer surface of the flat part 3*a*.

The lower edge of the holding plate 16 secures the heat exchanger 3 to the upper, drain pan 7. However, a gap exists between the lower edge of the heat exchanger 3 and the upper drain pan 7, because the heat exchanger 3 is inclined as described above. A member is provided, filling this gap, not imposing an adverse effect on the heat-exchanging efficiency of the heat source unit Y.

The holding plates 16 thus hold the heat exchangers 3 together, providing a structure shaped like a letter V as seen from side. A coupling member (not shown) connects the holding plates 16 to each other. The heat exchangers 3 are therefore held, each inclined at a specific angle. One end of the coupling member is secured to the top plate 4. As a result, the heat exchange module M is reliably held and installed.

Figure 5:
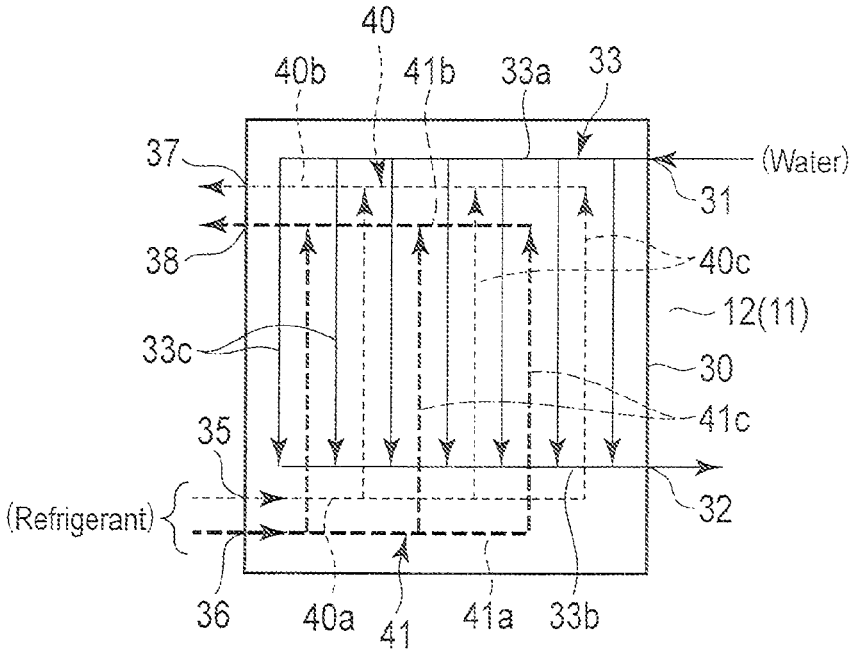
FIG. 5 is a diagram explaining the refrigerant passage and water passage of a water heat exchanger incorporated in the heat source unit.

FIG. 5 is a diagram schematically showing the internal structure of the first water heat exchanger 12 and that of the second water heat exchanger 11. The water heat exchangers 12 and 11 are identical in configuration. Therefore, only the first water heat exchanger 12 will be described. With reference to FIG. 5, it will be explained how cooling water is acquired to achieve cooling.

The first water heat exchanger 12 has a housing 30. In one side of the housing 30, a water-inlet port 31 and a water-outlet port 32 are made, one spaced apart from the other. The water supply pipes described above are connected to the water-inlet port 31 and water-outlet port 32, respectively. The water supply pipes connected to the water-inlet port 31 and water-outlet port 32 are different, as will be described later, from the water supply pipes connected to the water-inlet port and water-outlet port of the second water heat exchanger 11.

In the housing 30, a water passage 33 is provided, connecting the water-inlet port 31 and water-outlet port 32. The water passage 33 comprises two water guiding paths 33*a* and 33*b* parallel to each other. The water guiding path 33*a* and water guiding path 33*b* are connected to the water-inlet port 31 and the water-outlet port 32, respectively. The water guiding paths 33*a* and 33*b* extend from the water-inlet port 31 and water-outlet port 32, respectively, and are closed at the other end.

A plurality of water distributing paths 33*c* extend parallel to one another at regular intervals, between the water guiding paths 33*a* and 33*b* arranged parallel to each other. Thus, the water guiding paths 33*a* and 33*b* and the water distributing paths 33*c* constitute the water passage 33 in the housing 30.

Therefore, the water introduced through the water-inlet port 31 is guided into the water guiding path 33*a*, then distributed into the water distributing paths 33*c* at a time, next collected in the other water guiding path 33*b*, and is finally discharged through the water-outlet port 32.

The housing 30 of the first water heat exchanger 12 has a first refrigerant inlet port 35 and a second refrigerant inlet port 36, in the side opposite to the side in which the water-inlet port 31 and water-outlet port 32 are is made. The first refrigerant inlet port and second refrigerant inlet port 36 are located adjacent to each other and opposed to the water-outlet port 32.

In the same side, a first refrigerant outlet port 37 and a second refrigerant outlet port 38 are made, opposed to the water-inlet port 31 and positioned close to each other. The first refrigerant inlet port 35 and second refrigerant inlet port 36 are connected to the first refrigerant outlet port 37 and second refrigerant outlet port 38, respectively, by refrigerant pipes as will be described later.

In the housing 30, a first refrigerant passage 40 is provided, connecting the first refrigerant inlet port 35 and the first refrigerant outlet port 37. Further, a second refrigerant passage 41 is provided, connecting the second refrigerant inlet port 36 and the second refrigerant outlet port 38.

The first refrigerant passage 40 comprises a refrigerant guiding path 40*a* and a refrigerant guiding path 40*b*. The refrigerant guiding path 40*a* is connected to the first refrigerant inlet port 35, and the refrigerant guiding path 40*b* is connected to the first refrigerant outlet port 37. The refrigerant guiding paths 40*a* and 40*b* extend parallel to each other, and are closed at the ends facing away from the first refrigerant inlet port 35 and first refrigerant outlet port 37, respectively.

The second refrigerant passage 41 comprises a refrigerant guiding path 41*a* and a refrigerant guiding path 41*b*. The refrigerant guiding path 41*a* is connected to the second refrigerant inlet port 36, and the refrigerant guiding path 41*b* is connected to the second refrigerant outlet port 38. The refrigerant guiding paths 41*a* and 41*b* extend parallel to each other, and are closed at the ends facing away from the second refrigerant inlet port 36 and second refrigerant outlet port 38, respectively.

A plurality of water distributing paths 40*c* extend parallel to one another at regular intervals, between the water guiding paths 40*a* and 40*b* of the refrigerant passage 40, which are arranged parallel to each other. Further, a plurality of water distributing paths 41*c* extend parallel to one another at regular intervals, between the water guiding paths 41*a* and 41*b* of the refrigerant passage 41, which are arranged parallel to each other. Thus, the first refrigerant passage 40 and the second refrigerant passage 41 are constituted in the housing 30.

Note that the water distributing paths 33*c* of the water passage 33, the water distributing paths 40*c* of the first refrigerant passage 40, and the water distributing paths 41*c* of the second refrigerant passage 41 extend parallel, spaced apart, one from another, at regular intervals. Moreover, the water distributing paths 40*c* of the first refrigerant passage 40 and the water distributing paths 41*c* of the second refrigerant passage 41 are alternately arranged.

Thus, the water distributing paths 40*c* of the first refrigerant passage 40 and the water distributing paths 41*c* of the second refrigerant passage 41 are alternately arranged, with partitions provided between them, and located among the water distributing paths 33*c* that extend parallel to one another. The housing 30 of the first water heat exchanger 12 and the partitions defining the paths are made of material that excels in thermal conductivity. The water and refrigerant introduced into the housing 30 can therefore efficiently exchange heat.

The second water heat exchanger 11 has exactly the same structure as the first water heat exchanger 12, and will not be described. In order to heat water to accomplish heating, the refrigerant flows in the refrigerant passages 40 and 41 in the direction opposite to the direction indicated in FIG. 5.

Figure 6:
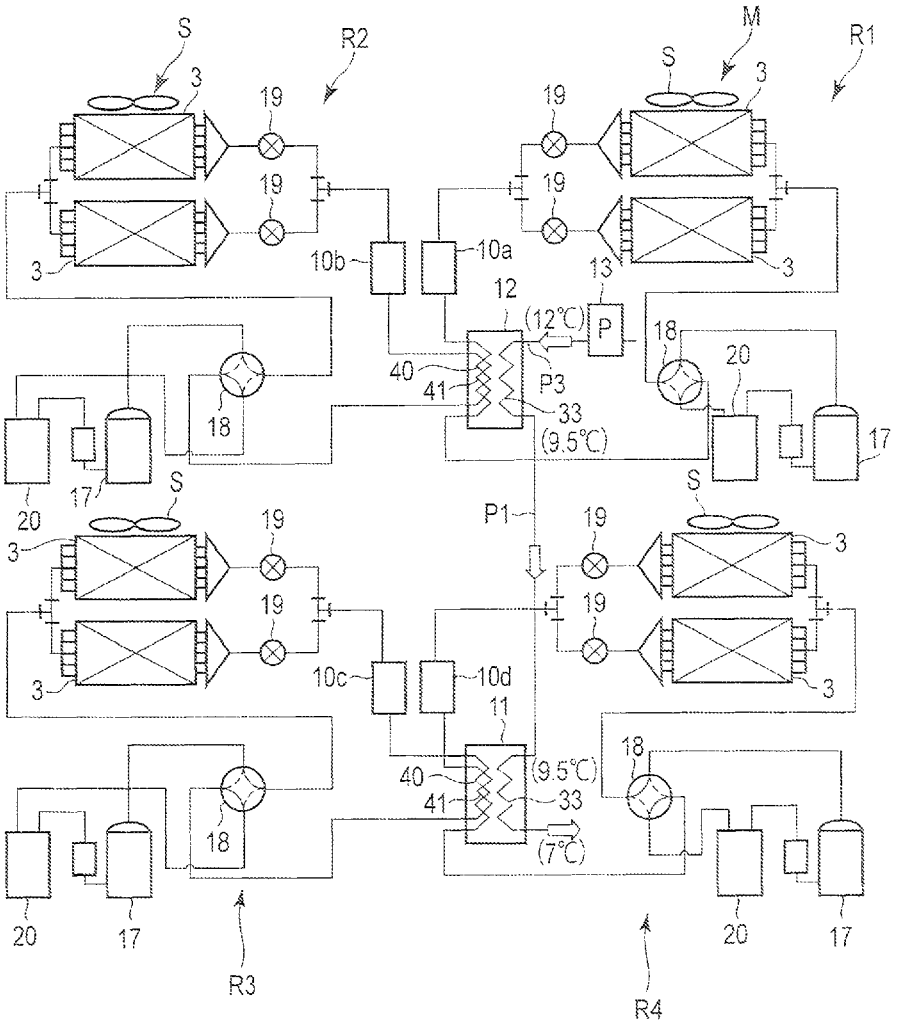
FIG. 6 is a diagram showing the configuration of the refrigeration cycle incorporated in the heat source unit.

FIG. 6 is a diagram showing the four refrigeration cycles R1 to R4 that are incorporated in the heat source unit Y.

The refrigeration cycles are identical in configuration, except for some features. Therefore, only the first refrigeration cycle R1 will be described, though the identical component of any refrigeration cycle are designate by the same reference numbers in FIG. 6.

The first port of a four-way valve 18 is connected to the outlet-side cooling pipe of a compressor 17. The refrigerant pipe connected to the second port of the four-way valve 18 is branched into two pipes, which communicate with a pair of air heat exchangers 3. The heat exchange pipes constituting the air heat exchangers 3 are combined, forming a composite pipe. The composite pipe communicates with branched refrigerant pipes, on which expansion valves 19 are provided.

These refrigerant pipes are combined, too, forming one pipe. This pipe communicates, via a first receiver 10*a* with the first refrigerant passage 40 provided in the first water heat exchanger 12. The first refrigerant passage 40 communicates with the third port of the four-way valve 18, through a refrigerant pipe. The fourth port of the four-way valve 18 communicates with the suction unit of the compressor 17, through an accumulator 20.

While the first refrigeration cycle R1 is so constituted, the water pump 13, to which the return pipe extending from the room to be air-conditioned, is connected by the third water supply pipe P3 to the water-inlet port 31 of the first water heat exchanger 12.

The water pump 13 therefore communicates with the water passage 33 of the first water heat exchanger 12, extends from the water-outlet port 32 and communicates, via the first water supply pipe P1, to with the second water heat exchanger 11. In the second water heat exchanger 11, the first water supply pipe P1 is connected to the water-inlet port 31, communicating with the water passage 33, and is connected to the second water supply pipe P2, which is guided to the room to be air-conditioned.

The second refrigeration cycle R2 is configured in the same way, except that the refrigerant pipe communicating with the second receiver 10*b* and four-way valve 18 is connected to the second refrigerant passage 41 of the first water heat exchanger 12.

As described above, in the first water heat exchanger 12, the first refrigerant passage 40 and second refrigerant passage 41 are alternately arranged on either side of one water passage 33. The water heat exchanger 12 is shared by two systems, i.e., first refrigeration cycle R1 and second refrigeration cycle. R2.

Similarly, in the second water heat exchanger 11, a first refrigerant passage 40 communicating with the third receiver 10C and a second refrigerant passage 41 communicating with a fourth reliever 10*d* are alternately arranged on either side of one water passage 33. The water heat exchanger 11 is shared by two systems, i.e., third refrigeration cycle R3 and fourth refrigeration cycle R4.

As explained with reference to FIG. 1, the machine compartment 2 incorporates the first water heat exchanger 12 and the second water heat exchanger 11, and also the components of the four refrigeration cycles. Each of the water heat exchangers 12 and 11 is shared by two systems, i.e., two refrigeration cycles. The water pump 13 and water supply pipes P1 to P3 connect the first water heat exchanger 12 and the second water heat exchanger 11 in series.

In the heat source unit Y so configured, cold water used in cooling mode is acquired as will be described below.

If the compressors 17 of the first to fourth refrigeration cycles R1 to R4 are driven at a time, compressing the refrigerant, they discharge the refrigerant gas at high temperature and high pressure. In each refrigeration cycle, the refrigerant gas is guided from the four-way valve 18 to a pair of air heat exchangers 3. The refrigerant gas exchanges heat with the air supplied by the blower S. The refrigerant gas is condensed and liquefied. The liquefied refrigerant is guided to the expansion valves 19. In the expansion valves 19, the refrigerant undergoes adiabatic expansion.

The resultant streams of refrigerant gas confluence and accumulate in receivers 10*a* to 10*d*. Then, the refrigerant gas is guided to the first refrigerant passage 40 and second refrigerant passage 11 of the first water heat exchanger 12 and exchanges heat with the water that has been guided into the water passage 33. In the water passage 33, the water in is cooled, changing to cold water.

The first water heat exchanger 12 can cools the water at high efficiency because it has the first and second refrigerant passages 40 and 41 communicating with the first and second refrigeration cycles R1 and R2, respectively. If the water supplied from the water pump 13 has a temperature of, for example, 12° C., it is cooled in the first water heat exchanger 12 to 9.5° C., or by 2.5° C., by the refrigerant guided into the refrigerant passages 40 and 41 of the two refrigeration cycle.

The water so cooled, i.e., cold water, is guided through the first water supply pipes P1 to the second refrigerant passage 11. Also in the second refrigerant passage 11, the water exchanges heat with the first and second refrigerant passages 40 and 41 that communicate with the third and fourth refrigeration cycles R3 and R4, respectively. Hence, in the second refrigerant passage 11, the water introduced at a temperature of 9.5° C. is further cooled by 2.5° C., becoming colder water of 7° C. The cold water coming from the second refrigerant passage 11 is guided through the second water supply pipe P2 to the room to be air-conditioned. The cold water cools air guided into the by an indoor fan. The air in the room is thereby cooled.

The refrigerant that has evaporated at the first water heat exchanger 12 and second water heat exchanger 11 is guided via the four-way valve 18 to the accumulator 20. The refrigerant undergoes gas-liquid separation, is drawn into the compressor 17 and is compressed again. The above-described refrigeration cycle is thus repeated.

Since the water passages 33 of the first and second water heat exchangers 12 and 11 are connected in series as described above, the cold water is cooled two times. This achieves higher cooling ability than otherwise.

Since the water heat exchangers 12 and 11 communicate, each with two refrigeration cycles, one compressor 17 can be provided in each refrigeration cycle. The refrigeration cycles therefore operate independently of one another. Therefore, the lubricating oil circulating in the refrigerant circuit need not be balanced in the compressor 7. A reduction in compressing ability, which would otherwise result from oil balancing, can be prevented.

Note that the conventional heat source unit indeed has fewer components. This is because the compressors are connected in parallel and the other refrigeration cycle components constitute one system, thereby sharing some components. However, pipes connecting the compressors must be used to make the oil balancing, and a system associated with the oil supply must be provided. This would cancel out the advantage resulting from the reduction in the component cost.

To compensate for a compressing ability reduction, if any, due to the oil balancing, the compressors must have higher compressing ability. Consequently, a large cost reduction can hardly be attained. Further, if one compressor stops operating due to some trouble, the other compressors must be stopped, stopping the refrigeration cycle. This decreases the reliability of the heat source unit.

In contrast, this embodiment is a heat source unit that comprises has a plurality of systems, i.e., refrigeration cycles. The refrigeration cycles share a water heat exchanger only, and each refrigeration cycle needs to ha have all other refrigeration, cycle components. The heat source unit therefore has many components indeed. Nonetheless, the refrigeration cycles is characterized in that the refrigeration cycles operate independently of one another. Hence, no pipes must be used to achieve oil balancing. Nor a system associated with the oil supply needs to be used. In addition, the compressing ability is never decreased, because the oil supply need not be made balanced.

Moreover, only the compressor with a trouble can be stopped and repaired because the refrigeration cycles operate independently of one another. Thus, the risk of stopping the entire unit in the event of a trouble is reduced, ultimately enhancing the reliability of the heat source unit.

That is, the first to fourth refrigeration cycles R1 to R4 are configured independently of one another in the present embodiment. Therefore, even if one of these refrigeration cycles stops operating, the other three refrigeration cycles keeps operating. The influence of the refrigeration cycle not operating is minimal. The heat source unit can remain reliable.

Hot water for heating is acquired as will be explained below.

The compressors 17 of all refrigeration cycles are driven at a time, compressing the refrigerant. As a result, the compressors 17 discharge the refrigerant gas at high temperature and high pressure. The refrigerant gas is guided from the four-way valve 18 to the first refrigerant passage 40 of the first water heat exchangers 12. The refrigerant gas therefore exchanges heat with the water guided to the water passages 33 from the water pump 13.

The refrigerant gas is liquefied in the first water heat exchangers 12, and the resulting heat of condensation heats the water in the water passages 33. In this case, too, the water is efficiently heated, becoming hot water, because the first water heat exchangers 12 has first and second refrigerant passages 40 and 41 that communicate with the two systems, i.e., first and second refrigeration cycles R1 and R2. Moreover, since the first water heat exchangers 12 and the second water heat exchanger 11 are connected in series, the hot water is heated twice, increasing the heating efficiency.

The liquid refrigerant supplied from the first water heat exchangers 12 is guided to the first receiver 10*a* and the expansion valves 19. The refrigerant first undergoes adiabatic expansion and then is guided to the air heat exchangers 3 and evaporates therein. The refrigerant is drawn into the compressor 17 through the four-way valve 18 and accumulator 20. The refrigerant is compressed again. The refrigeration cycle is thus repeated.

In the heating mode, wherein hot water is acquired, the refrigerant evaporates in a pair of air heat exchangers 3 that constitute the heat exchange module M, condensing the water in the air, forming drain water on the air heat exchangers 3. If the external temperature is extremely low, the drain water is frozen, most probably forting frost. The frost is detected by a sensor, which sends a signal to the control unit contained in the electrical parts box 8.

The control unit generates a command for switching the refrigeration cycle that has the air heat exchangers 3 on which the sensor has detected frost, from the heating mode to the cooling mode. Any refrigeration cycle in which the sensor detects no frost on the air heat exchangers 3 continues to operate in heating mode.

In the refrigeration cycle switched to the cooling mode, the four-way valve 18 is switched, guiding the refrigerant the refrigerant to the air heat exchangers 3. In the air heat exchangers 3, the refrigerant is condensed, changing to liquid refrigerant. As the refrigerant is so condensed, it releases heat of condensation. This heat melts the frost.

The shield plates 15 are provided on the sides of each heat exchange module M. No air therefore leaks through the gap between the air heat exchangers 3 opposed to each other, and air is prevented from flowing from any adjacent heat exchange module M. Hence, the air heat exchangers 3 operating to remove frost, on the one hand, and the air heat exchangers 3 continuously operating in the heating mode, on the other, do not thermally influence each other.

Assume that the four refrigeration cycles are all operating in the heating mode. Then, in each refrigeration cycle, the water heat exchangers 12 and 11 heat the hot water returning from the water pump 13 to the first water heat exchanger 12 is heated even if it is at a temperature of 40° C. That is, the hot water is heated to 45° C. at the time it is supplied from the second water heat exchanger 11.

Assume that one of the four refrigeration cycles is switched from the heating mode to the cooling mode, thereby to remove the frost from the air heat exchangers 3 of the refrigeration cycle. In this refrigeration cycle, the refrigerant evaporates in, for example, the first refrigerant passage 40 of the first water heat exchanger 12, cooling the hot water guided to the first water heat exchangers 12. However, the refrigerant is condensed in the second refrigerant passage 41 of the first water heat exchanger 12, which communicates with the second refrigeration cycle R2 continuously operating in the heating mode. The resultant heat of condensation is released to the hot water flowing in the water passage W.

The hot water guided from the first water heat exchanger 12 is cooled very little, within a narrow ranged. As a result, if only one refrigeration cycle is switched to the defrosting mode, the hot water supplied from the second water heat exchanger 11 will be cooled to 43.5° C., by 1.5° C. only. That is, the refrigeration cycles should better be switched to the defrosting mode, one by one, if frost is detected in two or more refrigeration cycles at the same time.

In contrast, the conventional heat source unit has only one refrigeration cycle even if a pair of air heat exchangers 3 stand, forming a V-shaped unit. It is not based on the idea of dividing the refrigeration cycle into some cycles. That is, the conventional heat source unit is configured as one refrigeration cycle.

To remove frost, the refrigeration cycle must be switched from the heating mode to the cooling mode. In the defrosting mode, the water passages provided in the water heat exchanger cannot heat water, only cooling the water. The hot water supplied, at the same temperature, from the water pump 13 is much cooled as it is discharged from the water heat exchanger. In view of this, the heat source unit according to this embodiment is far advantageous.

In this embodiment, each air heat exchanger 3 comprises a plurality of fins F are arranged at prescribed intervals, and heat exchange pipes P penetrating these fins F. The air heat exchanger 3 further comprises strips 3*b* bent at the lateral edges of the flat plate 3*a*, respectively, in the same direction. The air heat exchanger 3 therefore looks like a letter U as seen from above.

Therefore, the air to undergo heat exchange flows not only over the flat plate 3*a*, but also over the bent strips 3*b*. That is, the air undergoes heat exchange, not only at the front of the air heat exchanger 3 but also at the lateral edges thereof. This can enhance the heat exchange efficiency.

Even if the columns of heat exchanging pipes P that constitute the air heat exchanger 3 may be reduced in numbers, the air heat exchanger 3 only needs to have the same heat-exchanging area as the conventional air heat exchanger. Its size need not be increased in the longitudinal direction or the transverse direction.

As already described, a pair of air heat exchangers 3 (i.e., two air heat exchangers) are arranged, each with its bent strips 3*b* mutually opposed, and are then inclined, close to each other at the lower edge and spaced apart at the upper edge. The air heat exchangers 3 therefore constitute a heat exchange module M that is V-shaped as viewed from side.

In comparison with the conventional heat exchange module composed of two heat exchangers shaped like a flat plate and shaped like a letter V as viewed from side, the heat exchange module M is less broad because of the bent strips 3*b*, though having almost the same depth as the conventional heat exchange module.

In comparison with the conventional air heat exchanger having one plat plate, the air heat exchanger can more efficiently exchange heat while preserving the same heat heat-exchanging area. Further, the heat source unit Y requires but a smaller installation space than the conventional heat source unit.

The heat source unit Y is a unit that comprises the heat exchange modules M, the upper drain pan 7, and the machine compartment 2 incorporating all refrigeration cycle components K, but the pair of air heat exchangers 3. The heat exchange modules M are arranged side by side, in the direction orthogonal to the direction in which the air heat exchangers 3 are opposed to each other.

The heat exchange modules M arranged side by side are, of course, spaced apart by a minimum distance necessary. Air is smoothly introduced into the gaps between the heat exchange modules M. The air therefore smoothly flows over the left and right bent strips 3*b* of each air heat exchanger 3, which are arranged in the column direction. As a result, the bent strips 3*b* can increase the heat exchange efficiency.

Having air heat exchangers 3, each U-shaped as seen from above, each heat exchange module M can be short as measured in the direction orthogonal to the direction in which the air heat exchangers 3 face each other. Since the heat source unit Y comprises a plurality of heat exchange module M so configured, the more heat exchange module M are used, the greater will be the influence on the reduction in the installation space of the heat source unit Y.

In the heat source unit Y, a shield plate 15 closes the gap between either bent strip 3*b* of an air heat exchanger 3 and the associated bent strip 3*b* of the other air heat exchanger 3. One heat exchange module M and some refrigeration cycle components K constitute a refrigeration cycle that is independent from any other refrigeration cycle in the refrigeration cycle.

The refrigeration cycle operating in the defrosting mode is switched in operation, while the other refrigeration cycles need not be switched. Even in the defrosting mode, the temperature of the hot water supplied can therefore be kept as low as possible. Moreover, the temperature of the hot water will not be influenced by the heat emanating from the adjacent heat exchange modules M.

Figure 7:
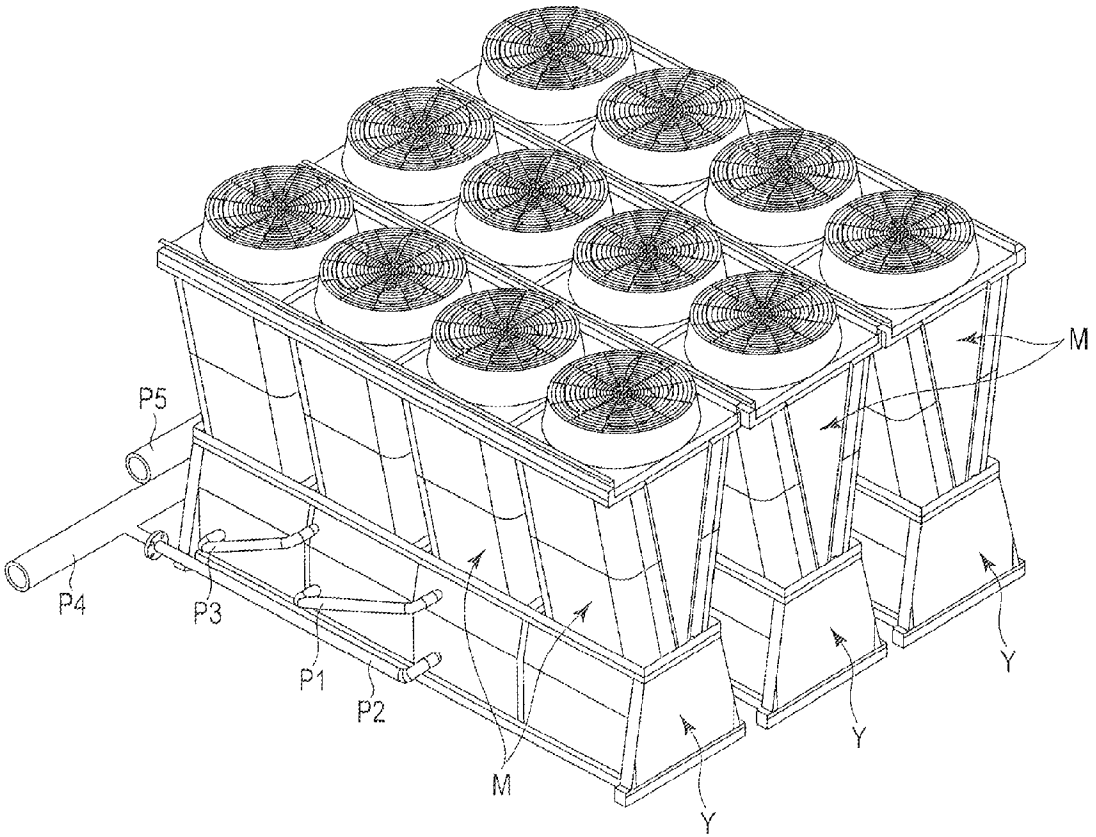
FIG. 7 is a perspective view showing an exemplary arrangement of heat source units.

FIG. 7 is a perspective view showing an exemplary arrangement of a system composed of a plurality of heat source units. More precisely, the system comprises three heat source units Y of the type shown in FIG. 1 arranged side by side, each unit Y comprising four heat exchange modules M connected together.

The top plates 4 of the respective heat source units Y are arranged, contacting one another. Nonetheless, the machine compartments of the heat source units Y are spaced apart by some distance. The machine compartment 2 of each heat source unit Y is covered with a panel N, which can prevent foreign substances from entering the machine compartment 2.

Thus, any two adjacent air heat exchangers 3 are spaced apart by a prescribed distance, and shield plates 15 are provided between any pair of air heat exchangers 3, preventing the heat-exchanging air from leaking from these air heat exchangers 3. The heat source units Y can therefore arranged more freely than otherwise.

Further, the heat source unit Y has water pumps 13, no installation space must be provided for the water pumps. This also make it possible to arrange the heat source units Y freely.

The heat source units Y are shaped like an hourglass as seen from side. A sufficient space is therefore provided between any two adjacent heat source units Y. Air can therefore freely flow, never hindering the efficiency of heat, exchange performed in the air heat exchangers 3. In addition, the space can be used as a passage the maintenance personnel may walk while performing maintenance work. This helps to raise the efficiency of maintenance work.

In each of the four heat exchange modules M constituting one heat source unit Y, the four refrigeration cycles are independent of one another. Hence, if the compressor 17 of any refrigeration cycle fails to operate, the refrigeration cycle is stopped and the compressor can be repaired, while all other refrigeration cycles keep operating. The risk of stopping all refrigeration cycles can be greatly reduced in the heat exchange module M.

Figure 8:
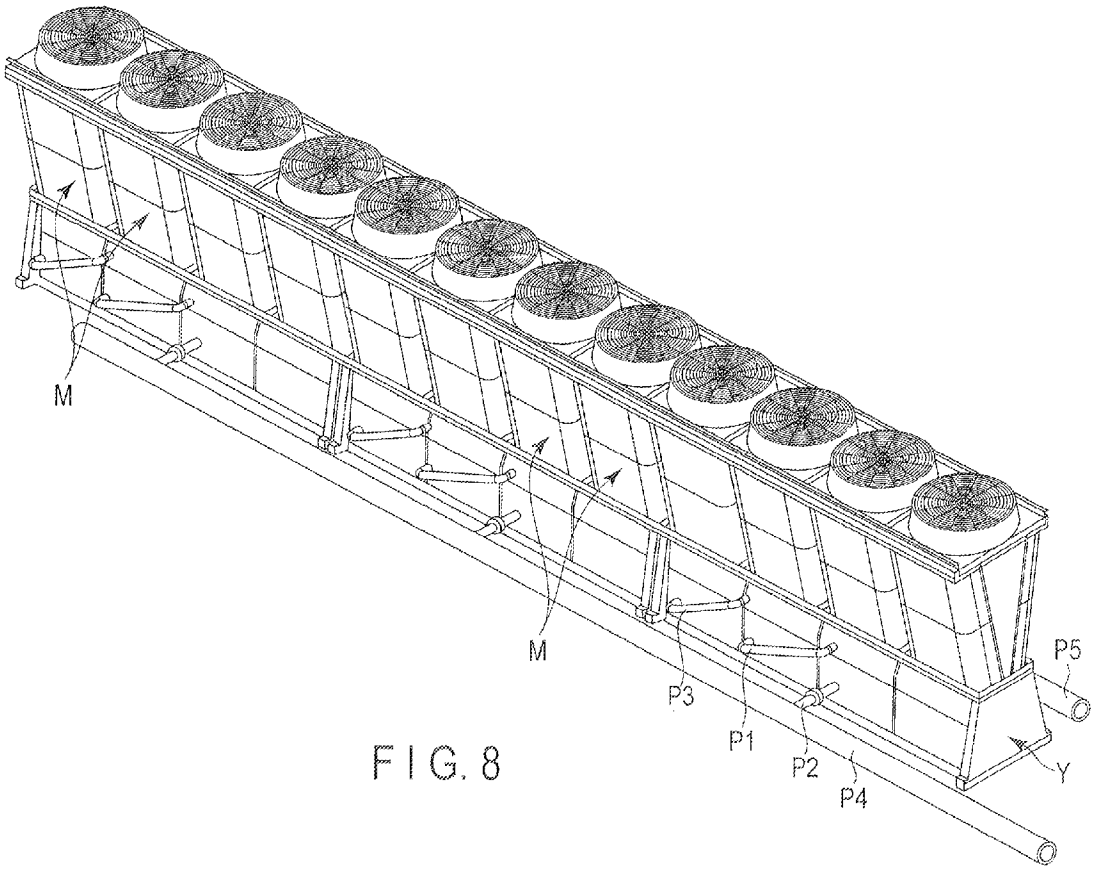
FIG. 8 is a perspective view showing another exemplary arrangement of the heat source unit.

FIG. 8 shows another exemplary arrangement of a system composed of a plurality of heat source units and fit for use in a huge building. More precisely, this system comprises three heat source units Y of the type shown in FIG. 1 coupled together in series, each unit Y having four heat exchange modules M.

Depending on the shaped of the huge building, such a rectangular installation space as shown in FIG. 7 may not be acquired. Instead, a narrow, long space may be available, which extends along a wall or a order with an adjacent next building.

In such an installation space, a plurality of heat source units Y may be arranged in series, constituting the system shown in FIG. 8.

To perform a maintenance work, the maintenance personnel may walk along the row of the heat source units Y, reaching the site where the work should be performed. He or she heed not take much time to start the work to repair, for example, the compressor 17 of any refrigeration cycle. The maintenance efficiency can therefore be increased.

These embodiments can provide a heat source unit comprising a plurality of refrigeration cycles. The heat source unit need not use a mechanism for achieving oil balancing in the compressors, thereby preventing a compressing ability decrease due to oil balancing, and has but a small risk of stopping in the event of the trouble in any compressor and therefore has high reliability.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A heat source unit comprising:

a plurality of pairs of air heat exchangers, each pair including at least one finned tube, each air heat exchanger including a flat plate part and bent strips, the bent strips being configured of opposite edge portions of the flat plate part bent in a same direction, and each air heat exchanger being substantially in a shape of a letter U as viewed from above;

shield plates configured to close a space between the bent strips of each pair of air heat exchangers and the bent strips of an adjacent pair of air heat exchangers; and a plurality of refrigeration cycles, each refrigeration cycle comprising one of the pairs of air heat exchangers and refrigeration cycle components;

a first water heat exchanger comprising a first water passage and a plurality of first refrigerant passages; and a second water heat exchanger comprising a second water passage and a plurality of second refrigerant passages, the second water passage connected to the first water passage in series, wherein:

the air heat exchangers within each pair are arranged in a direction facing each other, with opposed bent strips of the air heat exchangers within each pair extending toward each other, and having a gap between upper ends of the air heat exchangers within each pair that is wider than a gap between lower ends of the air heat exchangers within each pair;

the plurality of pairs of air heat exchangers are arranged side by side along a direction orthogonal to the direction in which the air heat exchangers of each pair face each other, and the plurality of pairs are spaced apart such that air flows between the bent strips of one pair of air heat exchangers and an adjacent pair of air heat exchangers; and a first set of the plurality of refrigeration cycles is connected to the refrigerant passages of the first water heat exchanger and a second set of the plurality of refrigeration cycles is connected to the refrigerant passages of the second water heat exchanger.

* * * * *